US009889972B2

(12) United States Patent
Sugai

(10) Patent No.: US 9,889,972 B2
(45) Date of Patent: Feb. 13, 2018

(54) BOTTLE CROWN SYSTEM

(71) Applicant: Kam Tech, LLC, Cheyenne, WY (US)

(72) Inventor: Chris Sugai, Cheyenne, WY (US)

(73) Assignee: Kam Tech, LLC, Cheyenne, WY (US)

( * ) Notice: Subject to any disclaimer, the term of this patent is extended or adjusted under 35 U.S.C. 154(b) by 30 days.

(21) Appl. No.: 14/857,631

(22) Filed: Sep. 17, 2015

(65) Prior Publication Data

US 2016/0081436 A1 Mar. 24, 2016

Related U.S. Application Data

(60) Provisional application No. 62/052,344, filed on Sep. 18, 2014.

(51) Int. Cl.

| | |
|---|---|
| ***A44B 1/18*** | (2006.01) |
| ***B65D 41/42*** | (2006.01) |
| ***G09F 7/04*** | (2006.01) |
| ***G09F 23/00*** | (2006.01) |
| *B65D 81/36* | (2006.01) |

(52) U.S. Cl.

CPC ..... *B65D 41/42* (2013.01); *G09F 7/04* (2013.01); *G09F 23/0091* (2013.01); *B65D 81/36* (2013.01)

(58) Field of Classification Search

CPC ..... Y10T 24/32; B65D 41/42; B65D 81/36; G09F 7/04; G09F 23/0091

See application file for complete search history.

(56) References Cited

U.S. PATENT DOCUMENTS

| | | | | |
|---|---|---|---|---|
| 5,974,634 A * | 11/1999 | Eisenpresser | ..... | A44B 1/04 24/303 |
| 7,703,786 B1 | 4/2010 | Domahidy et al. | | |
| 2016/0066656 A1* | 3/2016 | Ferris | ..... | A44B 1/04 24/303 |

* cited by examiner

*Primary Examiner* — Robert Sandy
*Assistant Examiner* — Michael S Lee
(74) *Attorney, Agent, or Firm* — Alleman Hall Creasman & Tuttle LLP

(57) ABSTRACT

A bottle crown engagement system includes a cap structure sized and shaped to releasably receive a bottle crown. The bottle crown engagement system also includes a magnetically attractable clamping member configured to magnetically interact with the cap structure to releasably affix the cap structure to an attachment surface between the cap structure and the magnetically attractable clamping member.

11 Claims, 4 Drawing Sheets

BOTTLE CROWN SYSTEM

CROSS REFERENCE TO RELATED APPLICATIONS

This application claims priority to U.S. Provisional Patent Application Ser. No. 62/052,344, filed Sep. 18, 2014, the entirety of which is hereby incorporated herein by reference.

BACKGROUND

Many beverages are sold in bottles sealed with bottle crowns. These bottle crowns may vary in texture and/or appearance according to the brand of beverage they were used to seal. Some people like to use bottle crowns as decorations.

SUMMARY

A bottle crown engagement system includes a cap structure sized and shaped to releasably receive a bottle crown. The bottle crown engagement system also includes a magnetically attractable clamping member configured to magnetically interact with the cap structure to releasably affix the cap structure to an attachment surface between the cap structure and the magnetically attractable clamping member.

DETAILED DESCRIPTION

Bottle crowns, which may be used to seal beverage containers, can provide an inexpensive and easy way to embellish the appearance of various items, such as clothing and accessories.

Figure 1:
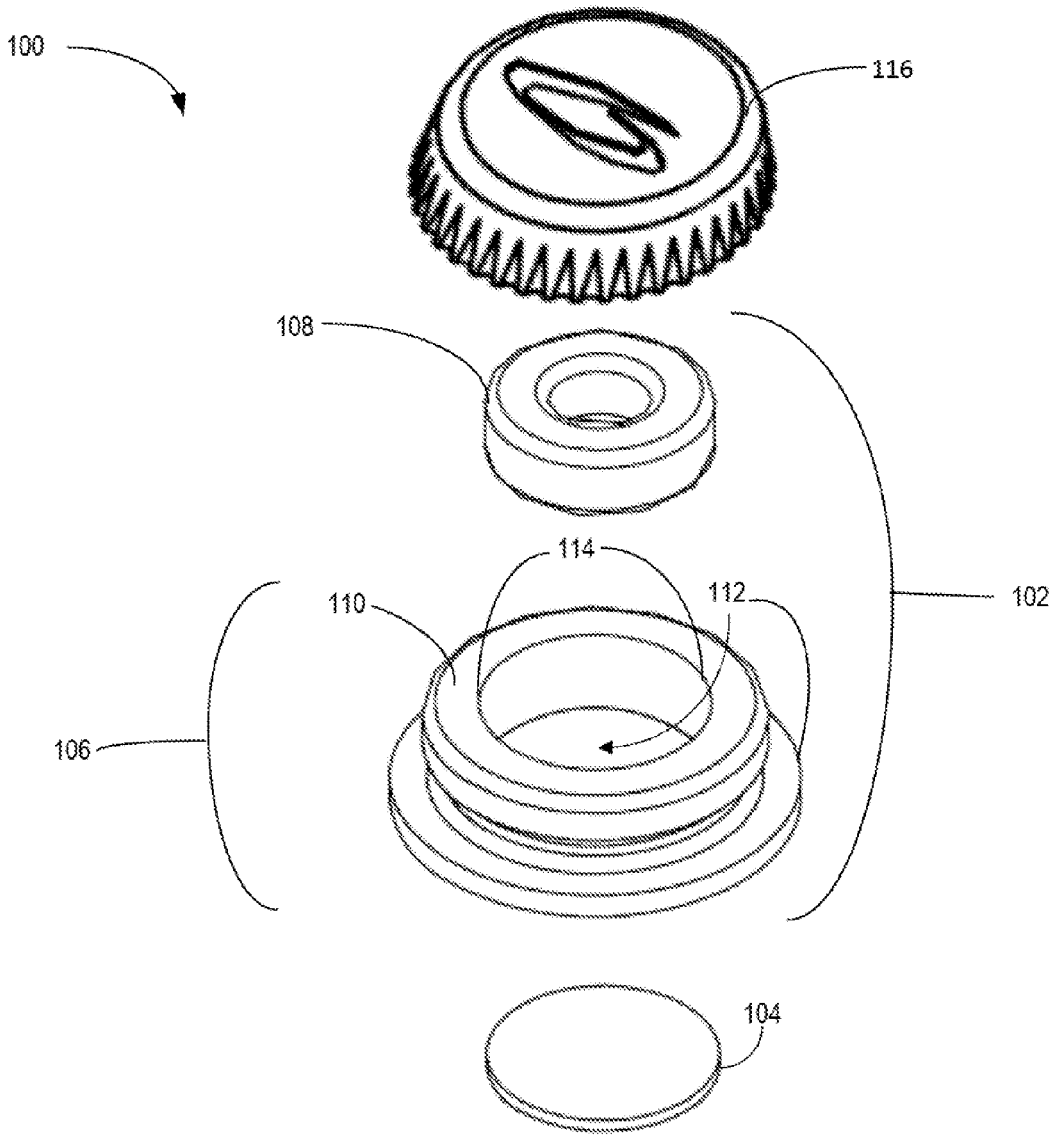
FIG. 1 shows an exploded view of a magnetic bottle crown engagement system.

FIG. 1 shows aspects of a bottle crown engagement system 100 which may be used to decorate physical objects. Components of bottle crown engagement system 100 may be configured to releasably receive a bottle crown 116. Further, magnetic attraction may be used to releasably affix components of bottle crown engagement system 100 to an attachment surface. This may allow a user to decorate, personalize, and/or otherwise embellish the attachment surface with the bottle crown, as will be described in further detail below.

Bottle crown engagement system 100 includes a cap structure 102 and a magnetically attractable clamping member 104. Cap structure 102 includes crown holder 106 and a magnet 108. The crown holder 106 in turn comprises an annular shoulder 110, a bottom support 112, and a magnet attachment recess 114. In the illustrated embodiment, annular shoulder 110 extends from bottom support 112, taking the form of an upraised ring, and defining the magnet attachment recess 114. In other words, magnet attachment recess 114 is defined as the space within the ring formed by annular shoulder 110. Bottom support 112 is below the annular shoulder 110 and defines the floor of magnet attachment recess 114. Bottom support 112 may extend completely across magnet attachment recess 114, or alternatively may form a rim around the perimeter of magnet attachment recess 114 while defining a window through the bottom of crown holder 106.

In the illustrated embodiment, annular shoulder 110 is sized and shaped to releasably receive a bottle crown 116. For example, bottle crown 116 may have previously been used to seal a beer bottle. Accordingly, the size and shape of the annular shoulder 110 may be substantially similar to the size and shape of a corresponding portion of a beer bottle. An attachment force may be applied to the bottle crown, thereby removably attaching it to annular shoulder 110. Crimped and/or uncrimped bottle crowns may be usable with engagement system 100.

It may in some cases be desirable to releasably affix the cap structure 102 to an attachment surface. This may be done in order to decorate, personalize, and/or otherwise embellish the attachment surface with bottle crown 116 removably attached to annular shoulder 110. For example, a cap structure 102, including bottle crown 116, may be releasably affixed to an article of clothing, such that the bottle crown is visible on the exterior of the article of clothing. Bottle crown engagement system 100 may be used to decorate and/or otherwise embellish virtually any suitable attachment surfaces including, for example, clothing, purses, backpacks, and windows, among others. Further, virtually any bottle crown of appropriate size and shape may be used. A user may select a bottle crown according to its aesthetic appearance, sentimental value, tactile feel, etc.

To this end, bottle crown engagement system 100 may be releasably affixed to an attachment surface in a variety of ways. In the illustrated embodiment, magnetic attraction is used to releasably affix the cap structure 102 to an attachment surface. As shown, magnet 108 may be inserted into magnet attachment recess 114. Magnet attachment recess 114 may be sized to hold the magnet. For example, magnet 108 may be a specific shape (e.g., a cylinder, a cube, a sphere, etc.) with specific dimensions, and magnet attachment recess 114 may take on a complementary shape with substantially similar dimensions. In other words, magnet attachment recess 114 may be substantially the same size and shape as magnet 108, such that when magnet 108 is inserted into magnet attachment recess 114, the bottom of magnet 108 is contacting/immediately adjacent to bottom support 112, and the sides of magnet 108 are contacting/immediately adjacent to the walls of magnet attachment recess 114.

Magnet 108 may be attached to crown holder 106 in any suitable way. In some embodiments, the magnet is removably insertable into the magnet attachment recess. For example, magnetic force between the magnet and the clamping member 104 may effectively attach the magnet to the crown holder 106. In alternative examples, the sides of magnet 108 may be threaded, and the sides of magnet attachment recess 114 may be correspondingly threaded, allowing the magnet to be threadingly fastened to the crown holder. Alternatively, magnet 108 may include one or more notches, grooves, hooks, latches, or other structures usable for removably attaching the magnet to the crown holder. Magnet 108 may include one or more grooves, recesses, notches, and/or other structures configured to receive one or more tools such as, for example, wrenches, screwdrivers, etc., for removably inserting the magnet into the magnet attachment recess. In other embodiments, magnet 108 may be non-removably attached to the crown holder. For example, magnet 108 may be glued to the crown holder in the magnet attachment recess, or embedded within crown holder 106. Other suitable mechanisms, fasteners, and/or structures may additionally be used to non-removably attach the magnet to the crown holder. Alternately, techniques for attaching the magnet to the crown holder may be utilized which do not include any fastening aids. Such techniques may include, for example, press fitting.

Bottle crown engagement system 100 additionally includes a magnetically attractable clamping member 104. In some embodiments, magnetically attractable clamping member 104 may be configured to magnetically interact with the magnet 108 to releasably affix the cap structure to an attachment surface. In particular, the magnetically attractable clamping member may include one or more ferromagnetic metals, which may be magnetically attracted to magnet 108. Additionally or alternatively, magnetically attractable clamping member 104 may include a magnet. This magnet may be aligned relative to magnet 108 such that an attractive force is generated. In some embodiments, cap structure 102 and magnetically attractable clamping member 104 may be positioned on opposite sides of an attachment surface, such that the attachment surface is interposed between cap structure 102 and magnetically attractable clamping member 104. As a result, once the cap structure and the clamping member are brought together with an appropriate proximity, magnetic attraction between the cap structure and the magnetically attractable clamping member may exert a compressive force on the attachment surface. This compressive force may serve to hold cap structure 102 in place at a position on the attachment surface, allowing for display of bottle crown 116 removably attached to annular shoulder 110. Manipulation of magnet 108, magnetically attractable clamping member 104, crown holder 106, and/or other components of bottle crown engagement system 100 may allow the cap structure 102 to be removed from the attachment surface and additionally allow the position of cap structure 102 relative to the attachment surface to be adjusted.

Figure 2:
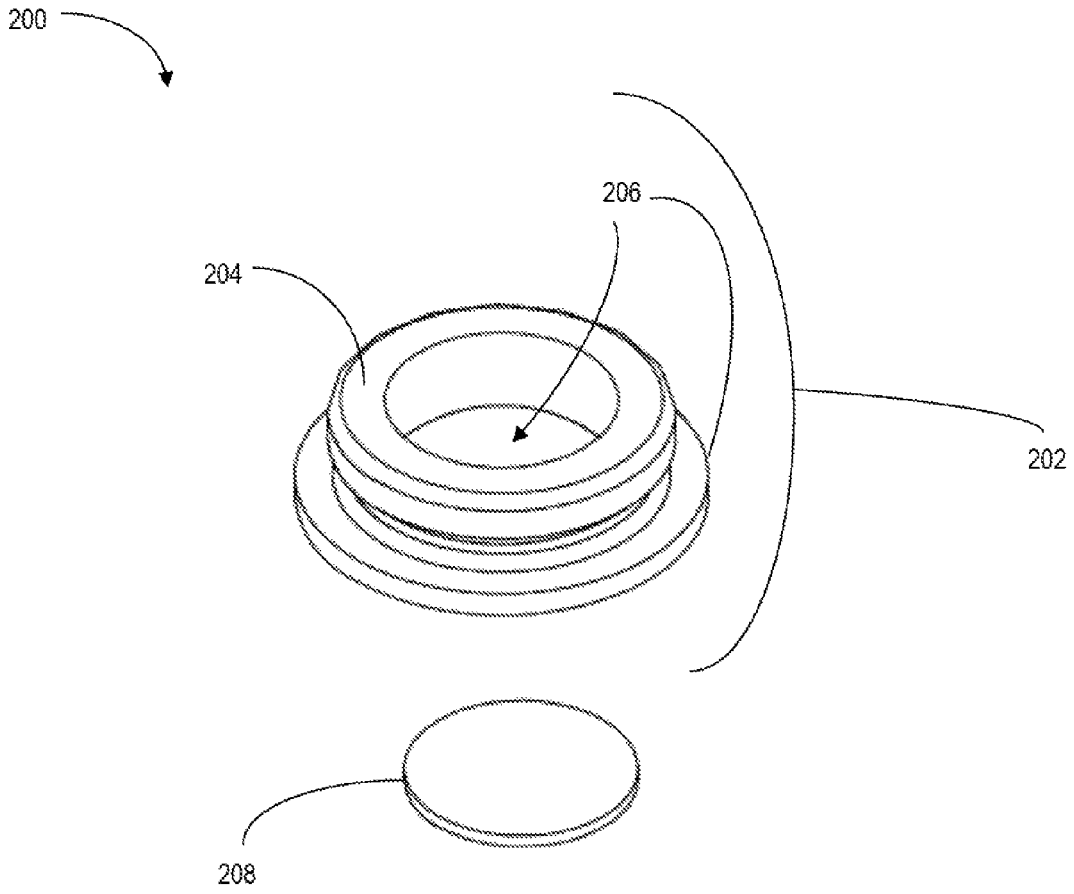
FIG. 2 shows an exploded view of a magnetic bottle crown engagement system.

FIG. 2 shows aspects of a bottle crown engagement system 200 which may be used to decorate physical objects. Similar to bottle crown engagement system 100, engagement system 200 is usable for decorating and/or embellishing an attachment surface with a bottle crown. To that end, engagement system 200 includes crown holder 202, annular shoulder 204, bottom support 206, and magnetically attractable clamping member 208. Annular shoulder 204 is sized and shaped to releasably receive a bottle crown (not shown).

In contrast to engagement system 100, crown holder 202 does not include a magnet akin to magnet 108. Rather, crown holder 202 is made from one or more ferromagnetic materials. Further, magnetically attractable clamping member 208 may include a magnet, which magnetically attracts the ferromagnetic materials of crown holder 202. Magnetic attraction between the crown holder and the magnetically attractable clamping member exerts a compressive force on the attachment surface. This compressive force may serve to hold crown holder 202 in place at a position on the attachment surface, allowing for display of a bottle crown removably attached to annular shoulder 204. Manipulation of the magnetically attractable clamping member 208, crown holder 202, and/or other components of bottle crown engagement system 200 may allow the crown holder 202 to be removed from the attachment surface and additionally allow the position of crown holder 202 relative to the attachment surface to be adjusted.

Figure 3A:
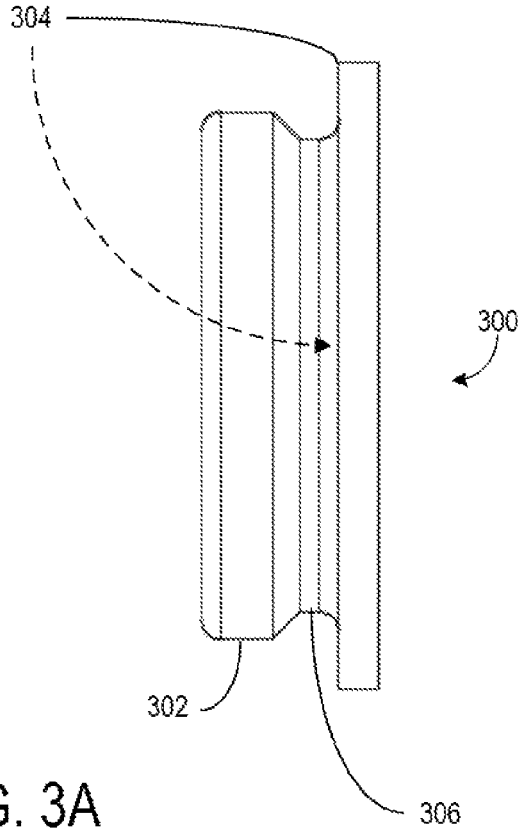
FIGS. 3A and 3B respectively show a side view and a top view of a crown holder of a magnetic bottle crown engagement system.
Figure 3B:
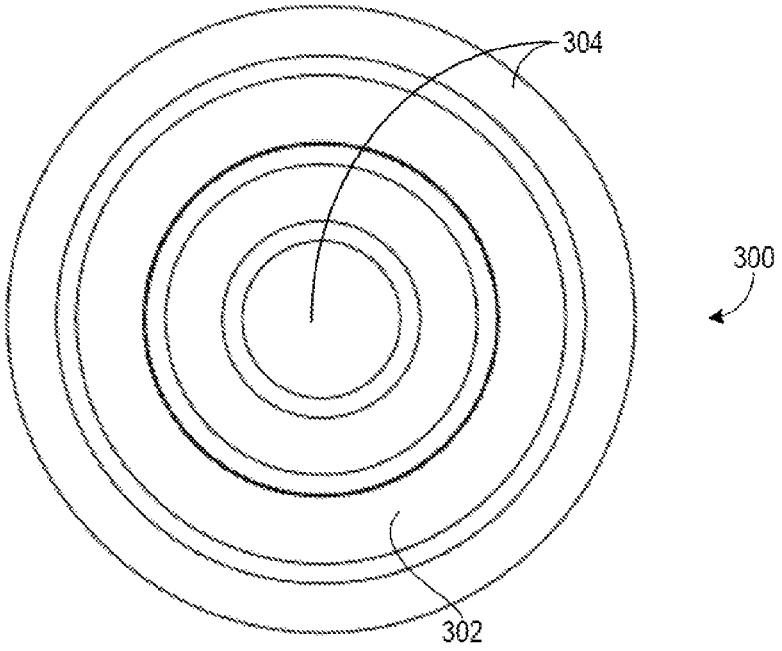

FIGS. 3A and 3B respectively show a side view and a top view of a crown holder 300 having a shape usable with either bottle crown engagement system 100 or bottle crown engagement system 200. Crown holder 300 includes an annular shoulder 302 and a bottom support 304. Annular shoulder 302 is configured to releasably receive a bottle crown, and as such may be shaped like the head of a typical beverage bottle to which the bottle crown might otherwise be crimped. An annular recess 306 is present between annular shoulder 302 and bottom support 304. Annular recess 306 has a smaller circumference than annular shoulder 302 and bottom support 304, and may be configured to have approximately the same size and dimensions as a beverage bottle neck. Annular recess 306 provides a rounded transition between annular shoulder 302 and bottom support 304. This rounded transition, in combination with the sizing (e.g., diameter) of shoulder 302, may allow a bottle crown to be removably attached to crown holder 300 if an attachment force is applied to the bottle crown.

Figure 4:
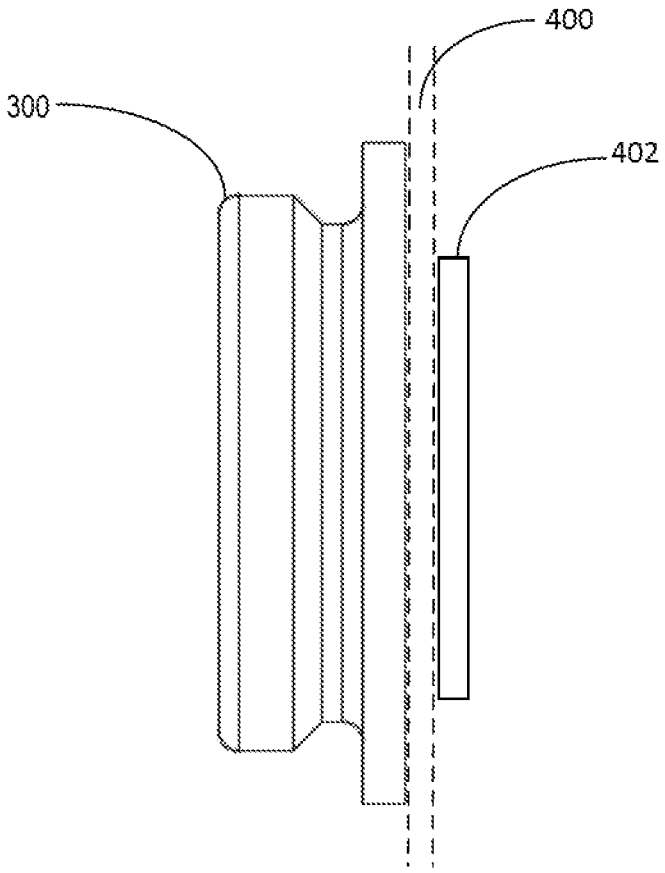
FIG. 4 shows a side view of a crown holder of a magnetic bottle crown engagement system releasably affixed to an attachment surface.

FIG. 4 shows a side view of crown holder 300 releasably affixed to an attachment surface 400. Crown holder 300 is positioned on one side of attachment surface 400, while magnetically attractable clamping member 402 is positioned on the other side. Crown holder 300 may be comprised of one or more ferromagnetic materials, and/or include one or more magnets, as described above. Magnetic attraction between crown holder 300 and magnetically attractable clamping member 402 may exert a compressive force on attachment surface 400, thereby holding crown holder 300 in place.

The components of engagement systems 100 and 200 may be comprised of various suitable materials. For example, crown holder 106 may be comprised of one or more plastics, ceramics, non-ferromagnetic metals (e.g., aluminum, copper, zinc, etc.), alloys thereof, etc. Crown holder 202, magnet 108, and magnetically attractable clamping mechanisms 104 and 208 may be made from a variety of suitable ferromagnetic metals and/or alloys thereof, including, for example, iron, nickel, cobalt, steel, etc.

Aspects of bottle crown engagement systems 100 and 200 may be modified in virtually any way, while remaining suitable for decorating an attachment surface with a bottle crown. For example, modifications to the geometries and dimensions (e.g., diameters, lengths, shapes, etc.) of the components of engagement systems 100 and 200 may be made. Engagement systems 100 and 200 may be modified to utilize one or more bolts, screws, and/or other suitable fasteners, so as to provide a more secure attachment to an attachment surface. Moreover, engagement systems 100 and 200 may be modified to accommodate objects other than bottle crowns, such as other types of beverage container caps, pins, buttons, etc. Such objects may include non-circular geometries, in some examples.

It will be understood that the configurations and/or approaches described herein are exemplary in nature, and that these specific embodiments or examples are not to be considered in a limiting sense, because numerous variations are possible.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A bottle crown engagement system, comprising:

a cap structure sized and shaped to mechanically hold a bottle crown useable with a standard beer bottle, the cap structure mimicking a mouth of the standard beer bottle, said cap structure consisting of, an annular shoulder having a first circumference equivalent to a mouth circumference of the standard beer bottle, an annular recess having a second circumference less than the first circumference, a bottom support having a third circumference, greater than the second circumference, the annular recess being between the annular shoulder and the bottom support, and a magnet attachment recess sized to hold a magnet; and a magnetically attractable clamping member configured to magnetically interact with the cap structure to releasably affix the cap structure to an attachment surface between the cap structure and the magnetically attractable clamping member.

2. The bottle crown engagement system of claim 1, further comprising a magnet.

3. The bottle crown engagement system of claim 2, wherein the magnet is held in the magnet attachment recess.

4. The bottle crown engagement system of claim 2, wherein the magnetically attractable clamping member includes one or more ferromagnetic metals.

5. The bottle crown engagement system of claim 4, wherein a portion of the cap structure that is sized and shaped to releasably receive the bottle crown is not ferromagnetic.

6. The bottle crown engagement system of claim 2, wherein the magnet is removable insertable into the magnet attachment recess.

7. The bottle crown engagement system of claim 1, wherein a portion of the cap structure that is sized and shaped to releasably receive the bottle crown is magnetically attractable to the magnetically attractable clamping member.

8. The bottle crown engagement system of claim 7, wherein the portion of the cap structure that is sized and shaped to releasably receive the bottle crown includes one or more ferromagnetic metals.

9. The bottle crown engagement system of claim 8, wherein the magnetically attractable clamping member includes a magnet.

10. The bottle crown engagement system of claim 1, wherein magnetic attraction between the cap structure and the magnetically attractable clamping member exerts a compressive force on the attachment surface between the cap structure and the magnetically attractable clamping member.

11. A bottle crown engagement system, comprising:

a cap structure sized and shaped to mechanically hold a bottle crown useable with a standard beer bottle, the cap structure being a ferromagnetic metal and mimicking a mouth of the standard beer bottle, said cap structure consisting of, an annular shoulder having a first circumference equivalent to a mouth circumference of the standard beer bottle, an annular recess having a second circumference less than the first circumference, and a bottom support having a third circumference, greater than the second circumference, the annular recess being between the annular shoulder and the bottom support; and a clamping member including a magnet configured to magnetically interact with the cap structure to releasably affix the cap structure to an attachment surface between the cap structure and the clamping member.

* * * * *